US009849560B2

(12) United States Patent
Lecompte

(10) Patent No.: US 9,849,560 B2
(45) Date of Patent: Dec. 26, 2017

(54) BLASTING SYSTEM AND METHOD OF USE

(71) Applicant: Benjamin J Lecompte, Houston, TX (US)

(72) Inventor: Benjamin J Lecompte, Houston, TX (US)

( * ) Notice: Subject to any disclaimer, the term of this patent is extended or adjusted under 35 U.S.C. 154(b) by 279 days.

(21) Appl. No.: 14/773,694

(22) PCT Filed: Mar. 7, 2014

(86) PCT No.: PCT/US2014/022170
§ 371 (c)(1),
(2) Date: Sep. 8, 2015

(87) PCT Pub. No.: WO2014/138713
PCT Pub. Date: Sep. 12, 2014

(65) Prior Publication Data

US 2016/0023326 A1 Jan. 28, 2016

Related U.S. Application Data

(60) Provisional application No. 61/773,816, filed on Mar. 7, 2013.

(51) Int. Cl.
*B24C 1/00* (2006.01)
*B24C 7/00* (2006.01)

(52) U.S. Cl.
CPC ..... *B24C 7/0038* (2013.01); *B24C 7/0023* (2013.01)

(58) Field of Classification Search
CPC ..... B24C 7/0023; B24C 7/0038
USPC ..... 451/101
See application file for complete search history.

(56) References Cited

U.S. PATENT DOCUMENTS 799,808 A * 9/1905 Thompson ..... B24C 7/0046 451/100
2,200,015 A * 5/1940 Alexandrescu ..... F16J 9/00 92/158
3,212,759 A * 10/1965 Brown ..... B28C 5/123 261/124
3,704,553 A * 12/1972 Hehr ..... B24C 7/0046 239/146
5,244,317 A * 9/1993 Kuboyama ..... B24C 7/0038 406/136
6,321,939 B1 * 11/2001 Treat ..... F16K 17/0433 222/195
2005/0003747 A1 * 1/2005 Dore ..... B24C 7/0038 451/90
2012/0015592 A1 * 1/2012 Eliason ..... B24C 7/0015 451/91
2017/0066107 A1 * 3/2017 Lecompte ..... B24C 1/00

* cited by examiner

*Primary Examiner* — Marc Carlson
(74) *Attorney, Agent, or Firm* — Shannon L. Warren

(57) ABSTRACT

A blasting system, comprising a tank, a center tube, an inlet, a top aperture. Said tank holds a slurry mixture for blasting application. Said inlet receives a pressurized air. Said center tube receives a portion of said pressurized air and selectively receives a portion of said slurry mixture. A portion of said center tube exits said tank at said top aperture. Said tank comprises a top end and a bottom end. Said relief valve regulates fluid capacity in said tank and relives pressure from said tank.

31 Claims, 10 Drawing Sheets

BLASTING SYSTEM AND METHOD OF USE

CROSS-REFERENCE TO RELATED APPLICATIONS

This national stage application claims benefit to PCT/US2014/022170 (filed on Mar. 7, 2014), which in turn claims benefit to U.S. Patent Application No. 61/773,816 (filed on Mar. 7, 2013). This national stage application is filed on Tuesday, Sep. 8, 2015, which is the day after Labor Day, where the USPTO was closed on Labor Day. Accordingly, this application is timely filed as a National Stage Application.

STATEMENT REGARDING FEDERALLY SPONSORED RESEARCH OR DEVELOPMENT (IF APPLICABLE)

Not applicable.

REFERENCE TO SEQUENCE LISTING, A TABLE, OR A COMPUTER PROGRAM LISTING COMPACT DISC APPENDIX (IF APPLICABLE)

Not applicable.

BACKGROUND OF THE INVENTION

This disclosure relates generally to an improved blasting system and method of use. Examples of similar disclosures can be found at U.S. Pat. No. 5,244,317, U.S. Pat. No. 6,321,939, US20050003747, and US20120015592. However, none of the known inventions and patents, taken either singularly or in combination, is seen to describe the instant disclosure as claimed. Accordingly, an improved blasting system and method of use would be advantageous.

BRIEF SUMMARY OF THE INVENTION

A blasting system, comprising a tank, a center tube, an inlet, a top aperture. Said tank holds a slurry mixture for blasting application. Said inlet receives a pressurized air. Said center tube receives a portion of said pressurized air and selectively receives a portion of said slurry mixture. A portion of said center tube exits said tank at said top aperture. Said tank comprises a top end and a bottom end. Said relief valve regulates fluid capacity in said tank and relieves pressure from said tank.

BRIEF DESCRIPTION OF THE SEVERAL VIEWS OF THE DRAWING

FIG. 6A also includes a cross-section view of said center tube.

FIG. 7A illustrates said center tube 516 in a closed configuration and FIG. 7B illustrates said center tube in an open configuration, as discussed below.

DETAILED DESCRIPTION OF THE INVENTION

Described herein is an Improved Blasting System and Method of Use. The following description is presented to enable any person skilled in the art to make and use the invention as claimed and is provided in the context of the particular examples discussed below, variations of which will be readily apparent to those skilled in the art. In the interest of clarity, not all features of an actual implementation are described in this specification. It will be appreciated that in the development of any such actual implementation (as in any development project), design decisions must be made to achieve the designers' specific goals (e.g., compliance with system- and business-related constraints), and that these goals will vary from one implementation to another. It will also be appreciated that such development effort might be complex and time-consuming, but would nevertheless be a routine undertaking for those of ordinary skill in the field of the appropriate art having the benefit of this disclosure. Accordingly, the claims appended hereto are not intended to be limited by the disclosed embodiments, but are to be accorded their widest scope consistent with the principles and features disclosed herein.

Figure 1A:
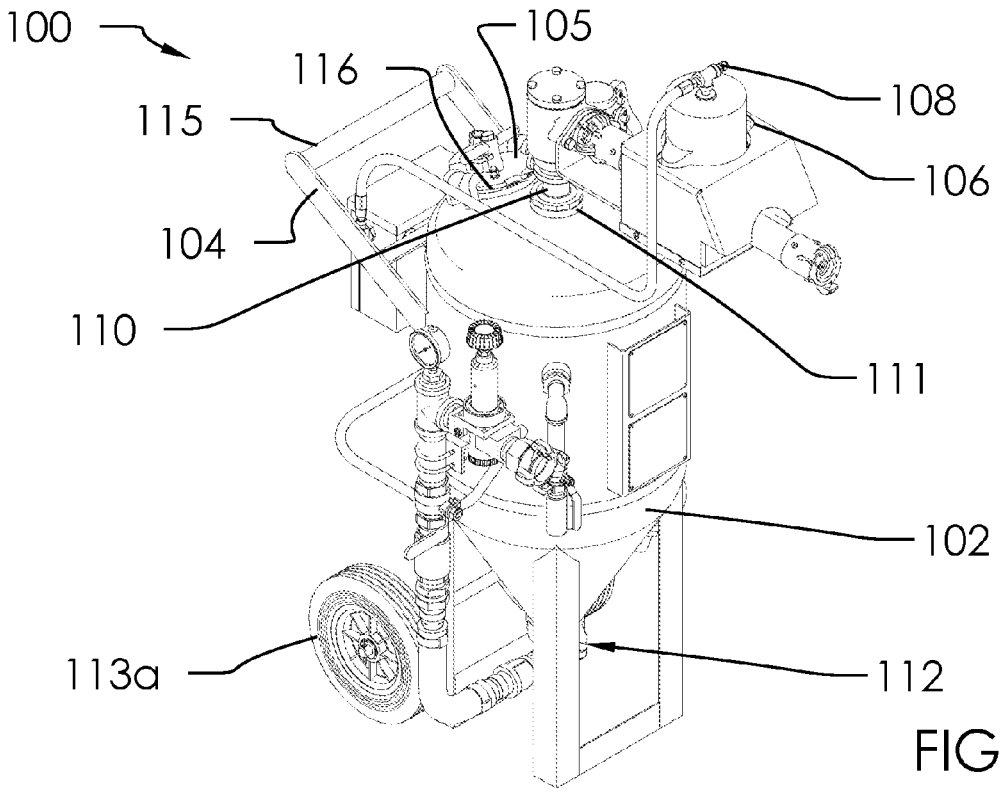
FIGS. 1A, IB and 1C illustrate a perspective first side and second side overview of a blasting system, and a flow diagram.
Figure 1B:
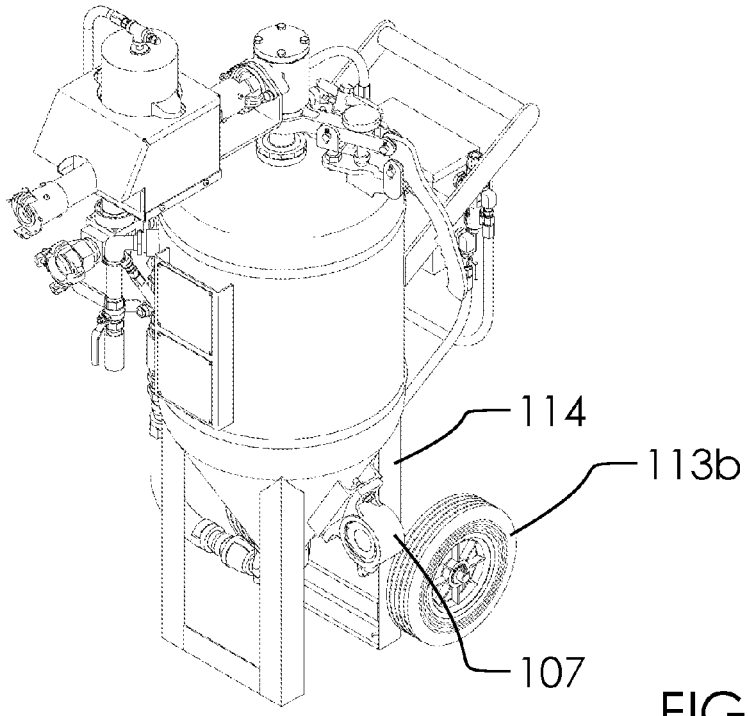

FIGS. 1A, IB and 1C illustrate a perspective first side and second side overview of a blasting system 100, and a flow diagram. In one embodiment, said blasting system 100 can comprise a tank 102, a cart 104, a venting cap 105, a pinch cutoff valve 106, a vibrator 107, a bleed valve 108, and a collar element 111. In one embodiment, said tank 102 can comprise an outlet 110, an inlet 112, and a bracket 114. In one embodiment, said cart 104 can attach to a portion of said tank 102 for easy mobility.

In one embodiment, said cart 104 can comprise a two wheels (comprising a first wheel 113*a* and a second wheel 113*b*) attached to said bracket 114; wherein, said bracket 114 attaches to said tank 102 and said two wheels allow said blasting system 100 to roll. Said cart 104 can comprise a handle 115.

Figure 1C:
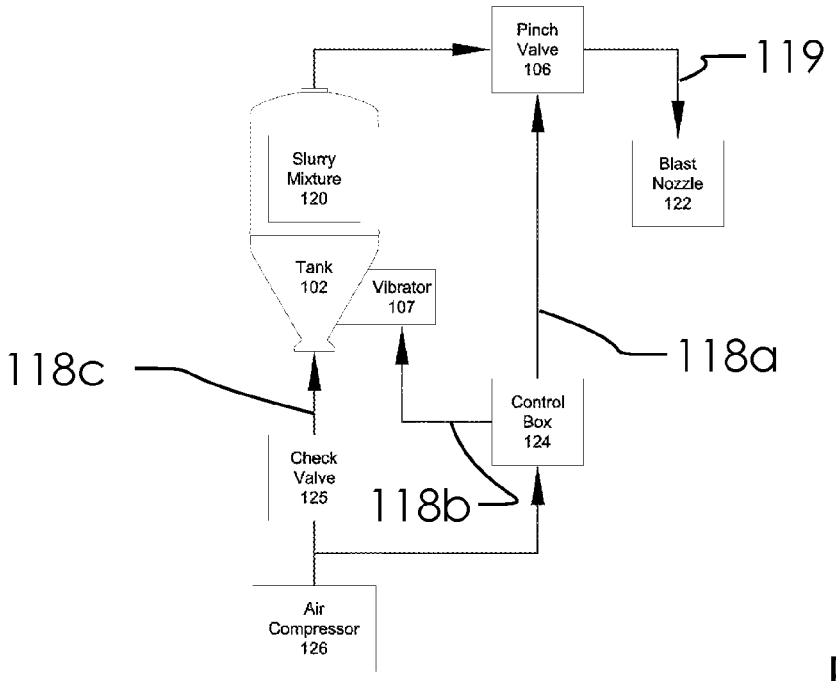

Turning to FIG. 1C, in one embodiment, said bleed valve 108 can regulate an air pressure applied into said outlet 110. In one embodiment, said venting cap 105 can attach to a refilling aperture 116. In one embodiment, a one or more air hoses can connect an air compressor 126 and said tank 102, said vibrator 107 and said pinch cutoff valve 106. In one embodiment, said one or more air hoses can comprise a valve air hose 118*a*, a vibrator air hose 118*b* and a tank air hose 118*c*. In one embodiment, said valve air hose 118*a* can attach to said pinch cutoff valve 106. In one embodiment, said vibrator air hose 118*b* can attach to said vibrator 107. In one embodiment, said tank air hose 118*c* can attach to said inlet 112. In one embodiment, said vibrator 107 can create a vibrating force against said tank 102 to keep a slurry mixture 120 moving through said tank 102. In one embodiment, said blasting system 100 can comprise a blasting hose 119. In one embodiment, said blasting hose can deliver a blasting fluid out of said blasting system 100.

In one embodiment, said blasting system 100, can comprise a blast nozzle 122, a control box 124, a check valve 125 and said air compressor 126. In one embodiment, a compressed air can pass from said air compressor into said control box 124 and on to a remaining portion of said blasting system 100. In one embodiment, said control box 124, can transfer said compressed air to said tank 102, said vibrator 107, and/or to said pinch cutoff valve 106, as discussed above. In one embodiment, said check valve 125 can be placed between said tank 102 and said control box 124. In one embodiment, said check valve 125 can ensure that said compressed air from said control box 124 and said air compressor 126 do not send too much air pressure into said tank 102. In one embodiment, said compressed air can mix with a slurry mixture 120 within said tank 102, passing through said pinch cutoff valve 106, and out of said blast nozzle 122.

In one embodiment, said vibrator 107 can maintain a viscosity of said slurry mixture 120 by vibrating said tank 102. In one embodiment, said vibrator 107 can be caused to shake by supplying a compressed air to said vibrator 107. In one embodiment, said pinch cutoff valve 106 can close a fluid passage within said blasting hose 119, between said tank 102 and said blast nozzle 122.

Figure 2A:
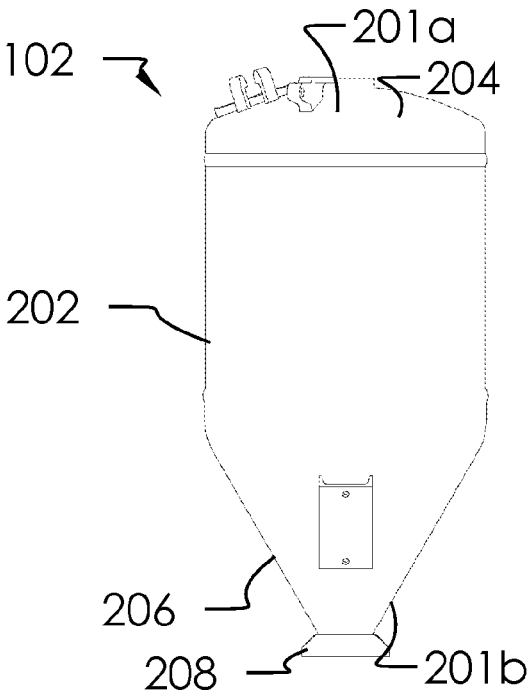
FIGS. 2A, 2B and 2C illustrate an elevated side view, top view and bottom view of said tank.
Figure 2B:
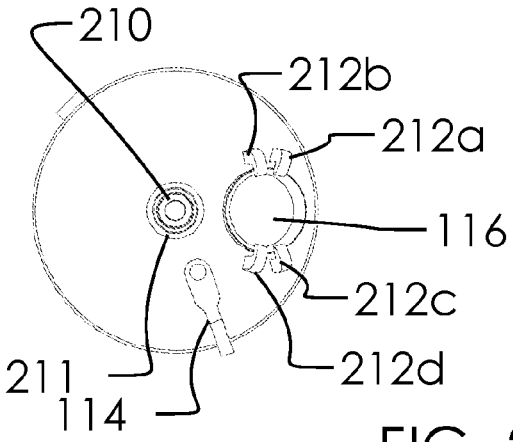
Figure 2C:
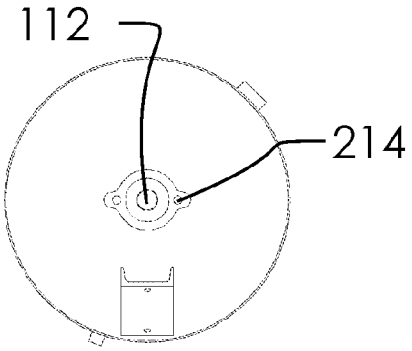

FIGS. 2A, 2B and 2C illustrate an elevated side view, top view and bottom view of said tank 102. In one embodiment, said tank 102 can comprise a top end 201*a*, a bottom end 201*b*, a shell 202, a cap 204, a cone 206, a neck 208, a top aperture 211, said threading 210 and a one or more lug nuts. In one embodiment, said one or more lug nuts can comprise a first lug nut 212*a*, a second lug nut 212*b*, a third lug nut 212*c*, and a fourth lug nut 212*d*. In one embodiment, said collar element 111 can attach to said threading 210 of said outlet 110. In one embodiment, said valve air hose 118*c* can attach to said inlet 112 at said bracket 214.

Figure 3A:
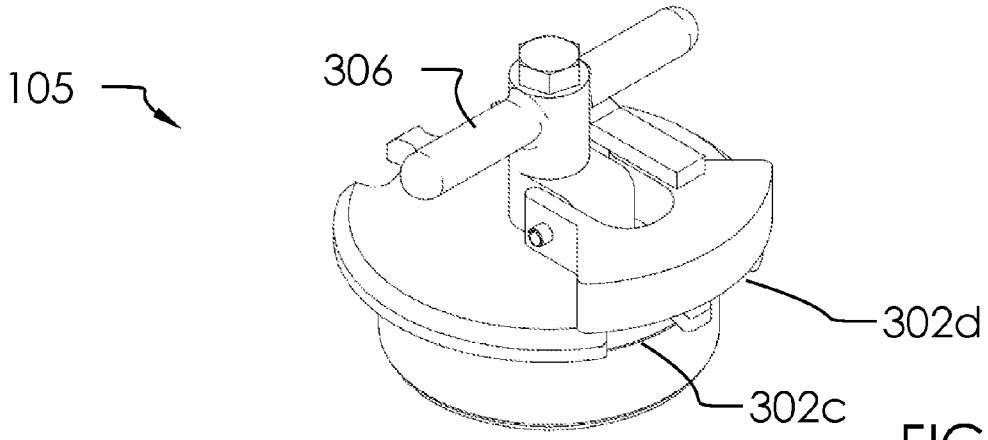
FIGS. 3A, 3B and 3C illustrate a perspective overview, an elevated side view, and an elevated top view of said venting cap.
Figure 3B:
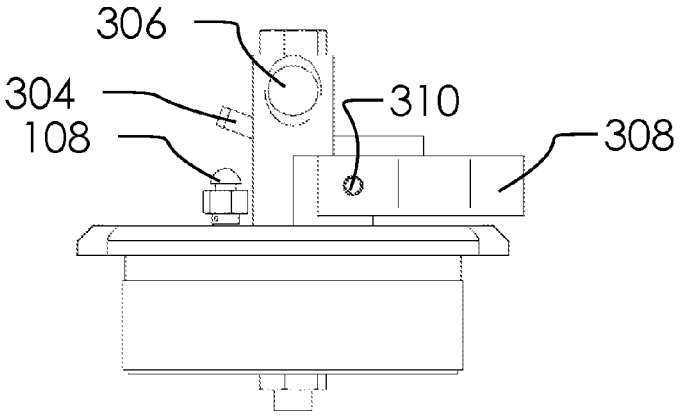
Figure 3C:
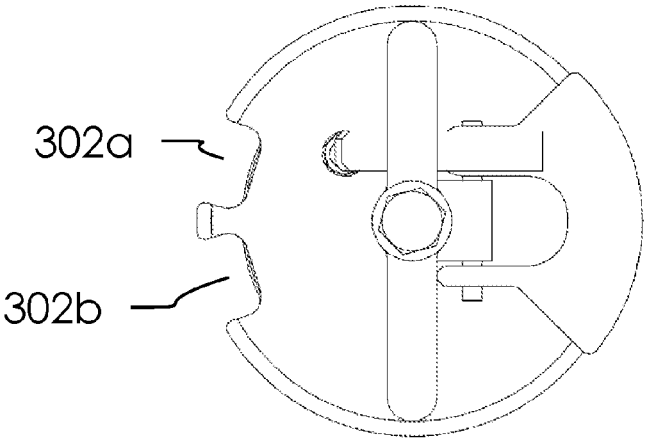

FIGS. 3A, 3B and 3C illustrate a perspective overview, an elevated side view, and an elevated top view of said venting cap 105. In one embodiment, said venting cap 105 can comprise said bleed valve 108, a one or more notches, a valve release arm 304, a handle 306, a lever 308, and a fulcrum 310. In one embodiment, said one or more notches can comprise a first notch 302*a*, a second notch 302*b*, a third notch 302*c*, a fourth notch 302*d*. In one embodiment, pressing said valve release arm 304 can open said bleed valve 108. In one embodiment, opening said bleed valve 108 can allow a gas in said tank 102 to be released, and thereby causing a pressure within said tank 102 to move toward an equilibrium with a pressure outside of said tank 102, as is known in the art.

Said venting cap 105 is one among many novel features of this disclosure, in that many prior blasting systems have caps that are bolted on tanks. In this case, however, said venting cap 105 is attached to said tank 102 by pressure when said tank 102 is pressurized. Accordingly, removing said venting cap 105 from said tank 102 requires that said tank 102 be depressurized.

Figure 4A:
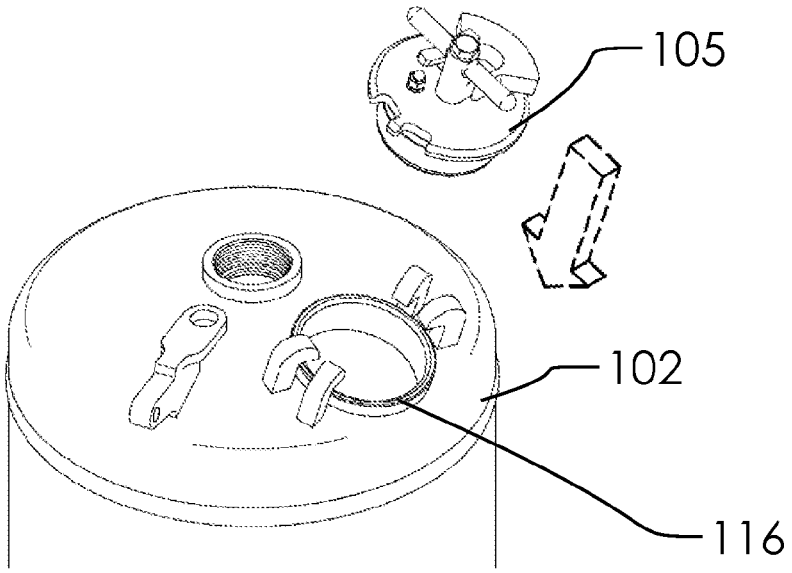
FIGS. 4A, 4B and 4C illustrate a series of perspective overviews of said venting cap; first, removed from said tank, next placed on top of, but not fastened to said refilling aperture, and finally fastened to said refilling aperture.
Figure 4B:
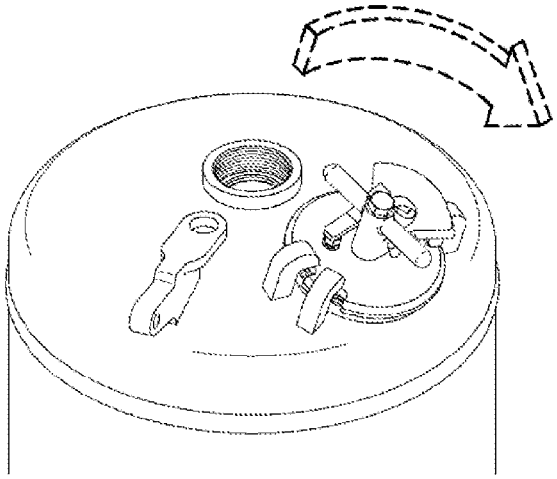
Figure 4C:
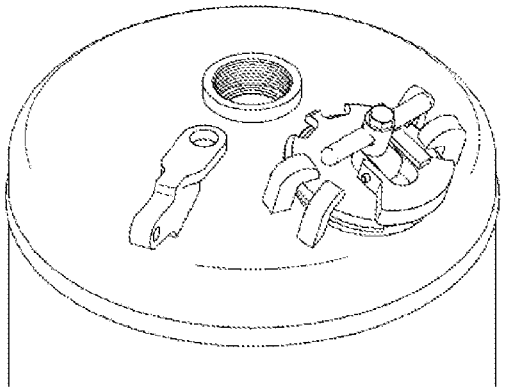

FIGS. 4A, 4B and 4C illustrate a series of perspective overviews of said venting cap 105; first, removed from said tank 102, next placed on top of, but not fastened to said refilling aperture 116, and finally fastened to said refilling aperture 116. In one embodiment, attaching said venting cap 105 to said tank 102 can comprise: aligning said one or more notches of said venting cap 105 with said one or more lug nuts of said tank 102 (illustrated FIG. 4A); sliding said one or more notches through said one or more lug nuts; pressing and sealing said venting cap 105 against said refilling aperture 116; rotating said venting cap 105 beneath said one or more lug nuts (illustrated FIG. 4B); and holding said venting cap 105 under said one or more lug nuts (illustrated FIG. 4C). In one embodiment, rotating said venting cap 105 beneath said one or more lug nuts can comprise rotating said venting cap 105 by 90 degrees. In one embodiment, an air pressure in said tank 102 must be bleed before removing said venting cap 105. In one embodiment, bleeding said air pressure in said tank 102 can comprise opening said bleed valve 108.

Figure 5A:
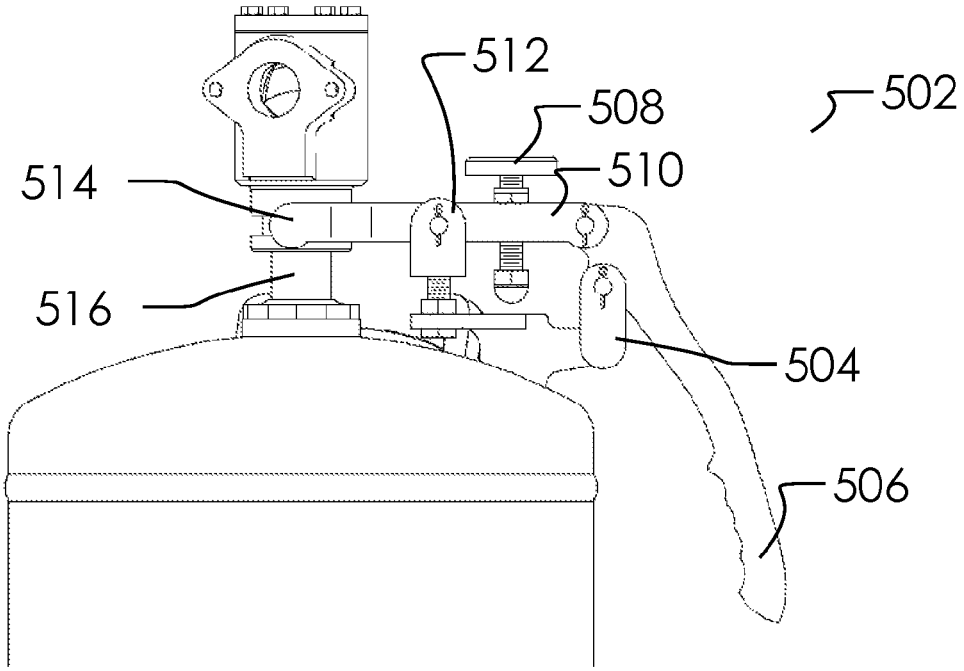
FIGS. 5A and 5B illustrate a perspective detailed overview of a position locking assembly in a closed position (FIG. 5A) and an open position (FIG. 5B).
Figure 5B:
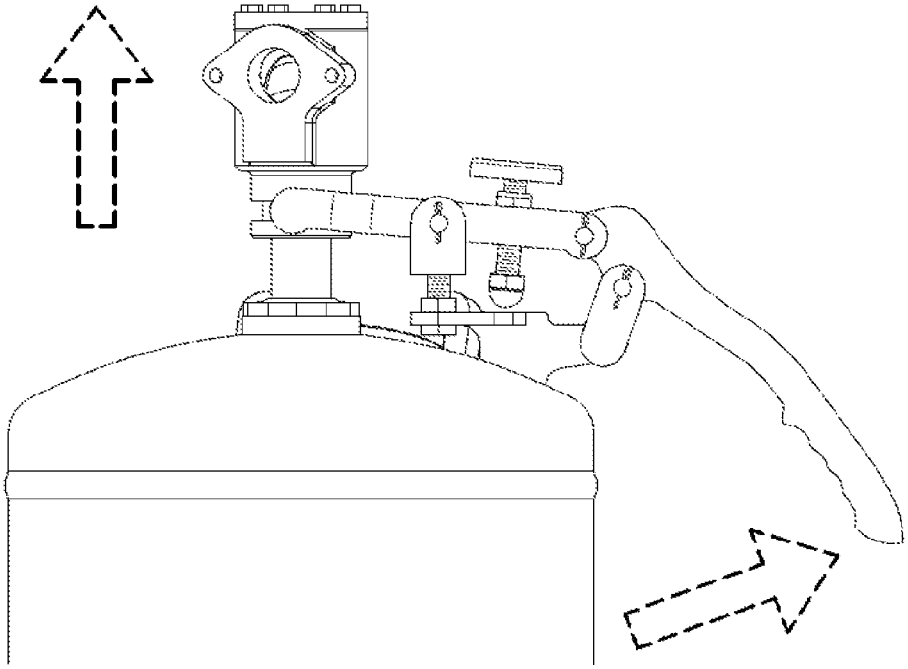

FIGS. 5A and 5B illustrate a perspective detailed overview of a position locking assembly 502 in a closed position (FIG. 5A) and an open position (FIG. 5B). In one embodiment, said position locking assembly 502 can comprise a lower hinge 504, a lever 506, a lock pin 508, an arm 510, a fulcrum 512, a clamp 514, and a center tube 516. In one embodiment, said lower hinge 504 can allow said lever 506 to rotate to either said closed position or said open position. In one embodiment, said lock pin 508 can be used to lock said in a particular location or, otherwise, to limit a range of motion of said position locking assembly 502. In one embodiment, said arm 510 can attach said lever 506 to said clamp 514. In one embodiment, said clamp 514 can hold said center tube 516 in place and allow said center tube 516 to be in said closed position or said open position. In one embodiment, when said position locking assembly 502 is in said closed position, said position locking assembly 502 will not allow said slurry mixture 120 to pass through said center tube 516. In one embodiment, when said position locking assembly 502 is in said open position, said position locking assembly 502 will allow said slurry mixture 120 to pass through said center tube 516.

Figure 6A:
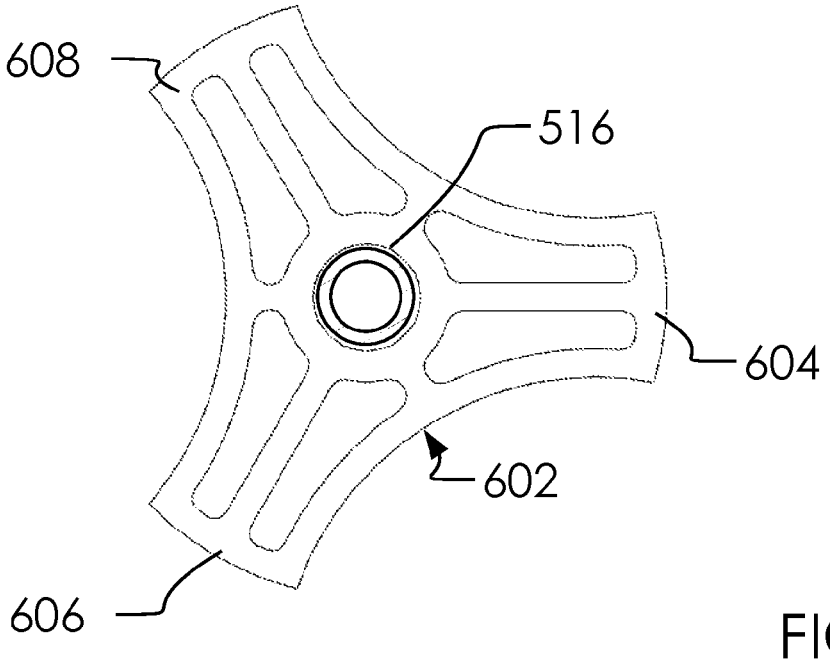
FIGS. 6A, 6B and 6C illustrate an elevated top view, an elevated side view, and a perspective overview of a filter.
Figure 6B:
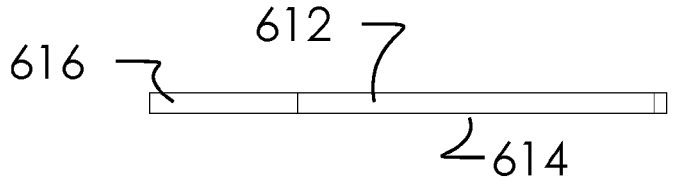
Figure 6C:
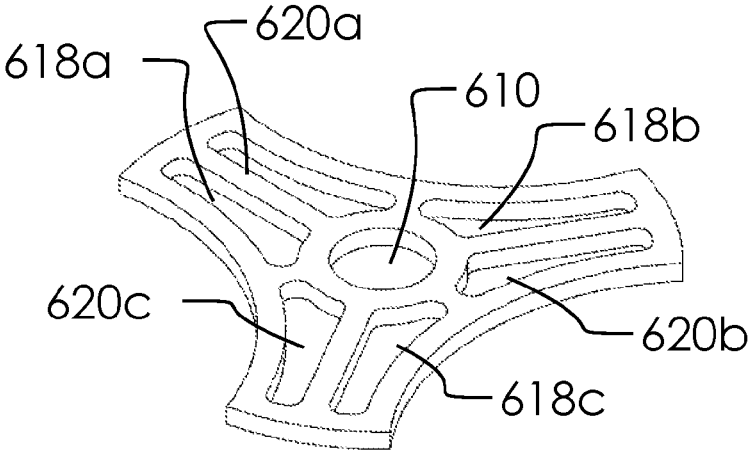

FIGS. 6A, 6B and 6C illustrate an elevated top view, an elevated side view, and a perspective overview of a filter 602. FIG. 6A also includes a cross-section view of said center tube 516. In one embodiment, said filter 602 can comprise a first portion 604, a second portion 606, a third portion 608, a center aperture 610, a top portion 612, a bottom portion 614, a side edge 616, a one or more apertures. In one embodiment, said one or apertures can comprise a first aperture 618*a*, a second aperture 618*b*, a third aperture 618*c*, a first aperture 620*a*, a second aperture 620*b*, and a third aperture 620*c*. In one embodiment, said first portion 604, said second portion 606, and said third portion 608 are substantially similar in design and extend outwardly from a center aperture 610. In one embodiment, said top portion 612 and said bottom portion 614 are substantially similar in design and can have a substantially flat surface area. In one embodiment, said side edge 616 extends around said filter 602.

Said center aperture 610 can comprise an internal diameter being larger than an external diameter of said center tube 516, which can allow said center tube 516 to have a minimal amount of movement. Said center aperture 610 can comprise a surface configured to allow said center tube to selectively rotate within said filter.

In one embodiment, a portion of said second portion 606, said third portion 608 and said center aperture 610 can be welded to a portion of said tank 102 to prevent said filter 602 from moving freely within said tank 102.

Figure 7A:
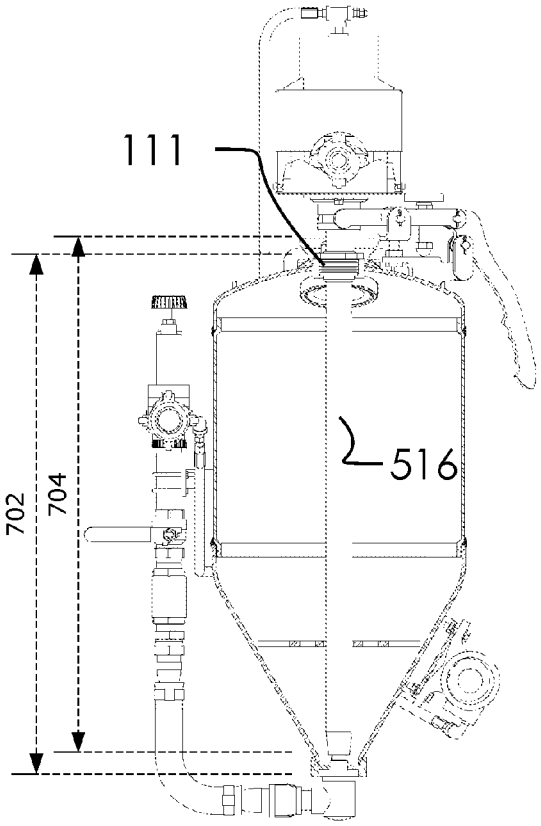
FIGS. 7A and 7B illustrate an elevated cross-section front view of two configurations of said tank.
Figure 7B:
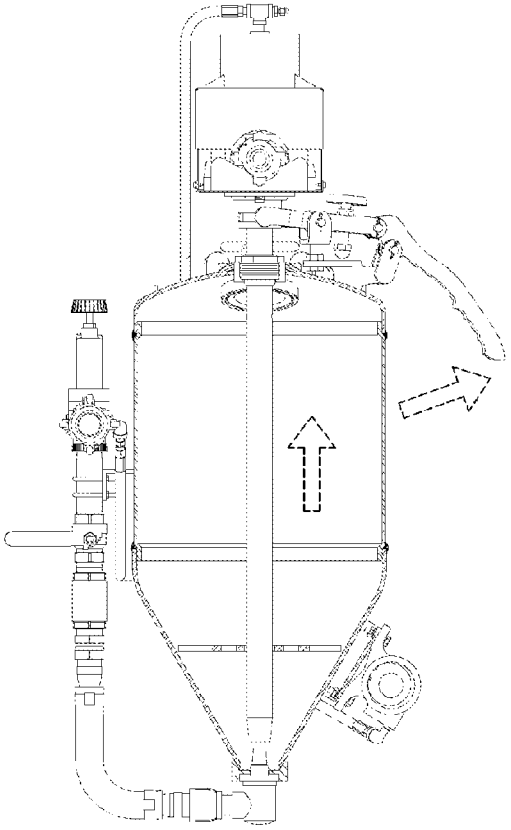

FIGS. 7A and 7B illustrate an elevated cross-section front view of two configurations of said tank 102. FIG. 7A illustrates said center tube 516 in a closed configuration and FIG. 7B illustrates said center tube 516 in an open configuration, as discussed below. In one embodiment, said tank 102 can comprise a height 702. In one embodiment, said center tube 516 can have a length 704 that can be substantially equal to said height 702 of said tank 102. In one embodiment, said vibrator 107 can be attached to said shell 202 and toward said cone 206. In one embodiment, said center tube 516 can pass through said center aperture 610 of said filter 602. In one embodiment, said cone 206, said filter 602 and said vibrator 107 can work together to ensure that said slurry mixture 120 moves freely through said tank 102 and remains properly mixed together. Said center tube 516 is capable of sliding up and down through said collar element 111 whilst retaining a fluid seal within said tank 102 at said collar element 111.

In one embodiment, with said center tube 516 open, said slurry mixture 120 can move into said center tube 516.

Figure 7C:
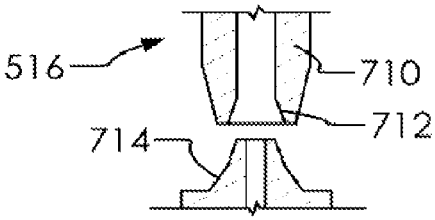
FIG. 7C illustrates an elevated cross-section front view of said center tube and a coupling nipple.

FIG. 7C illustrates an elevated cross-section front view of said center tube 516 and a coupling nipple 708. In one embodiment, a lower portion 710 of said center tube 516 can selectively connect to said coupling nipple 708. In one embodiment, said coupling nipple 708 can be in fluid connection with said inlet 112. In one embodiment, said lower portion 710 can comprise a beveled inner diameter 712, and said coupling nipple 708 can comprise a shoulder 714 as illustrated; wherein, said beveled inner diameter 712 can seal against said shoulder 714 when said center tube 516 is in a closed configuration (as in FIG. 7A).

In one embodiment, said center tube 516 can be moved to said closed position and said open position by rotating said lever 506 near said collar 111.

Figure 8A:
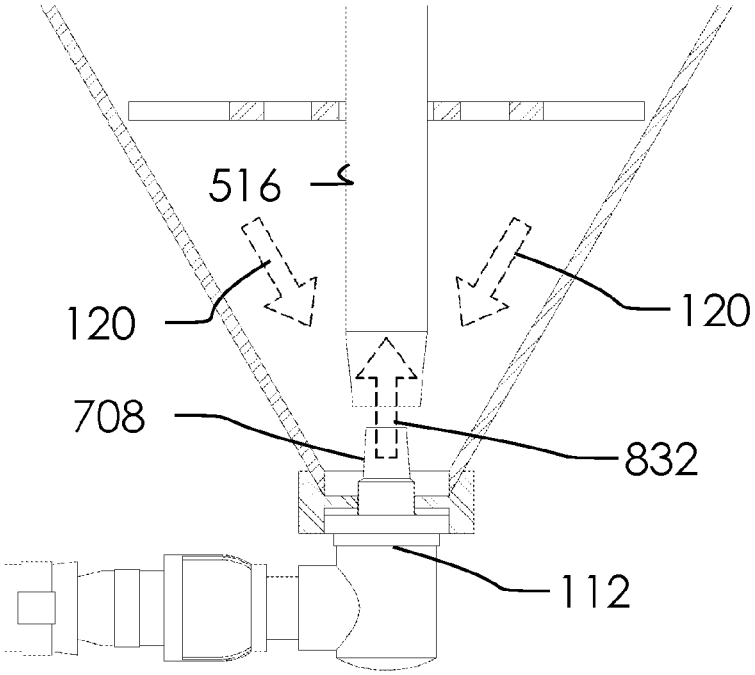
FIGS. 8A and 8B illustrate two elevated cross-section side overviews of said blasting system with said slurry mixture in motion.
Figure 8B:
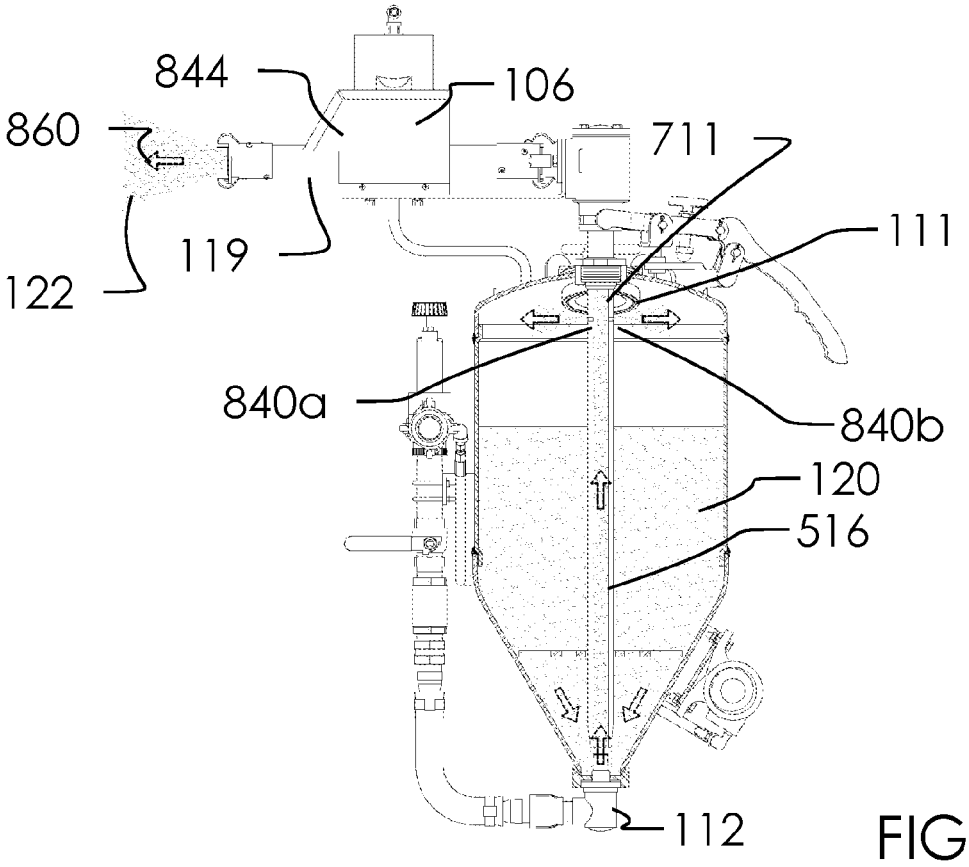

FIGS. 8A and 8B illustrate two elevated cross-section side overviews of said blasting system 100 with said slurry mixture 120 in motion.

In one embodiment, said cone 206 of said tank 102 can comprise an angle of repose 830 designed to ensure that said slurry mixture 120 moves through said tank 102. In one embodiment, the triple effect of said angle of repose 830, said vibrator 107 and said filter 602 can ensure that said slurry mixture 120 does not clog in said tank 102. In one embodiment, said angle of repose 830 can be about 60 degrees. In one embodiment, a higher value for said angle of repose 830 can be advantageous; thus an angle between 50 and 100 degrees may be useful. In one embodiment, flatter angles can lower a flow rate of said slurry mixture 120.

Focusing on FIG. 8A, said slurry mixture 120 moves into said center tube 516 with said blasting system 100 in said open configuration; likewise, a pressurized air 832 passes through said inlet 112, through said coupling nipple 708 and into said center tube 516 pulling said slurry mixture 120 at the same time.

Focusing now on FIG. 8B, a portion of said slurry mixture 120 can enter said center tube 516, mix with a portion of said pressurized air 832, pass to an upper portion 711 of said center tube 516, a portion exits a one or more internal hydraulic accumulators (comprising a first hydraulic accumulator 840*a* and a second hydraulic accumulator 840*b*), passing through an elbow 842, and exiting said blasting system 100 at said blast nozzle 122. In one embodiment, said one or more hydraulic accumulators can equalize pressure between said center tube 516 and said tank 102. Accordingly, a pressure from said upper portion 711 of said center tube 516 pushes down on a portion of said slurry mixture 120 stored in said tank 102. Thus, said blasting system 100 recognizes that dust is not compressible and the pressure equalization between said center tube 516 and said tank 102 ensures fluid movement of said slurry mixture 120 into said lower portion 710 of said center tube 516.

In one embodiment, said pinch cutoff valve 106 can cut off a fluid movement from said tank 102 to said blast nozzle 122 by blocking a flow out of said blasting hose 119. In one embodiment, said pinch cutoff valve 106 can be fail safe, such that if a portion of said blasting system 100 shuts down, said pinch cutoff valve 106 will close automatically. In one embodiment, said pinch cutoff valve 106 can be activated (opened) by said air compressor 126.

In one embodiment, said pinch cutoff valve 106 can have a splash guard 844 designed to redirect any spilled fluids from said blasting hose 119 downward away from a user of said blasting system 100.

In one embodiment, by lifting said lever 506, said center tube 516 and said lower portion 710 (nearest the bottom of the tank) can be raised and thereby allows said slurry mixture 120 in said tank 102 to enter in said lower portion 710 of said center tube 516. While said center tube 516 is in said open position and said closed position said collar 111 holds said tank in an air tight status wherein, said slurry mixture 120 is allowed to exit said tank only through said lower portion 710.

Said blasting system 100 can create a useful phenomenon while in use. In one embodiment, said tank air hose 118*c* can deliver hot air into said center tube 516, combine with said slurry mixture 120 in said center tube 516 and exit said blast nozzle 122 at a cold temperature.

A portion of said slurry mixture 120 is ejected from said blasting system 100 as a blast stream 860.

Figure 9A:
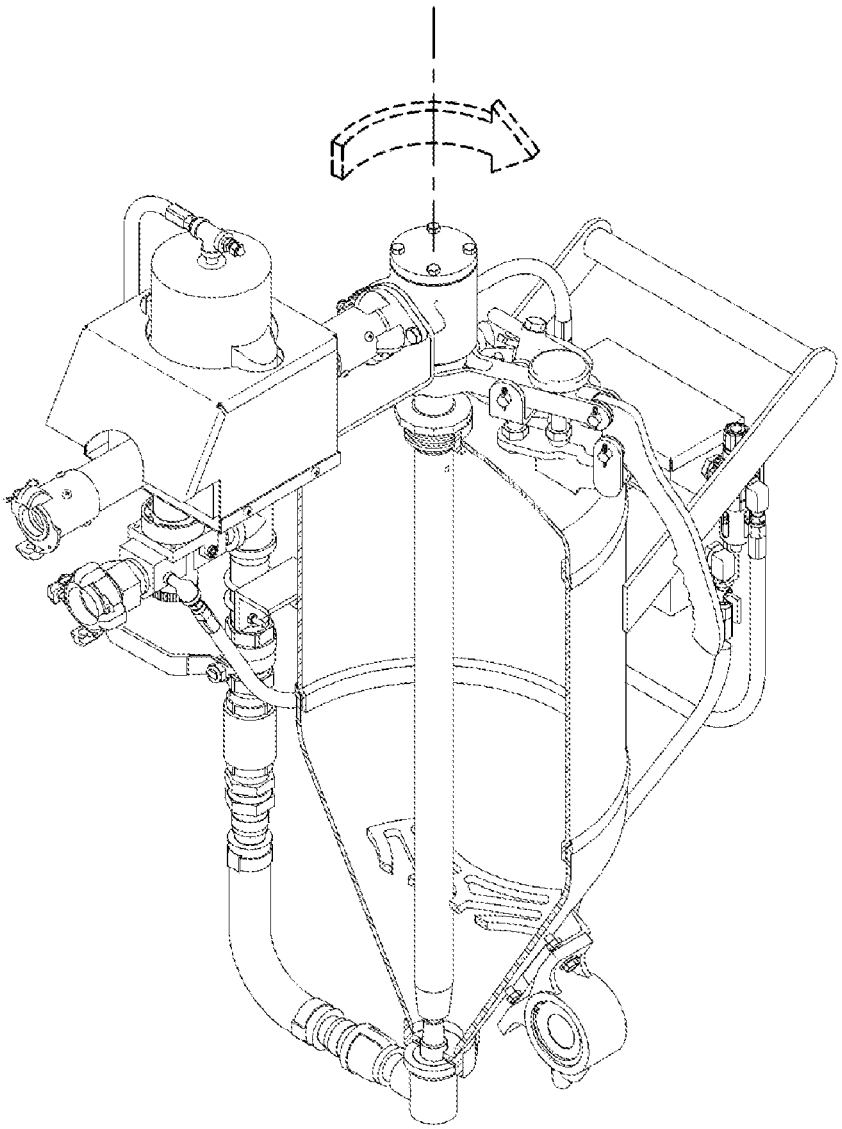
FIGS. 9A and 9B illustrate a perspective cross-section overview and an elevated top view of said blasting system.
Figure 9B:
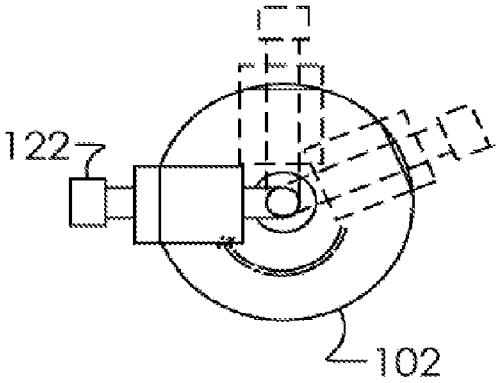

FIGS. 9A and 9B illustrate a perspective cross-section overview and an elevated top view of said blasting system 100.

In one embodiment, said bleed valve 108 can allow an air pressure within said valve air hose 118*a* to be vented at said pinch cutoff valve 106. Thus, in one embodiment, said bleed valve 108 can allow said pinch cutoff valve 106 to release its cutoff of said blast nozzle 122. In one embodiment, said center tube 516 and said pinch cutoff valve 106 can rotate freely relative to said shell 202; in so doing, said blasting hose 119 and blast nozzle 122 can move freely about said blasting system 100. This distinction is novel in the field, where the classic manner of pulling a slurry mixture out of a tank is by gravity, and 360 rotational movement is the exception not the rule.

Figure 10A:
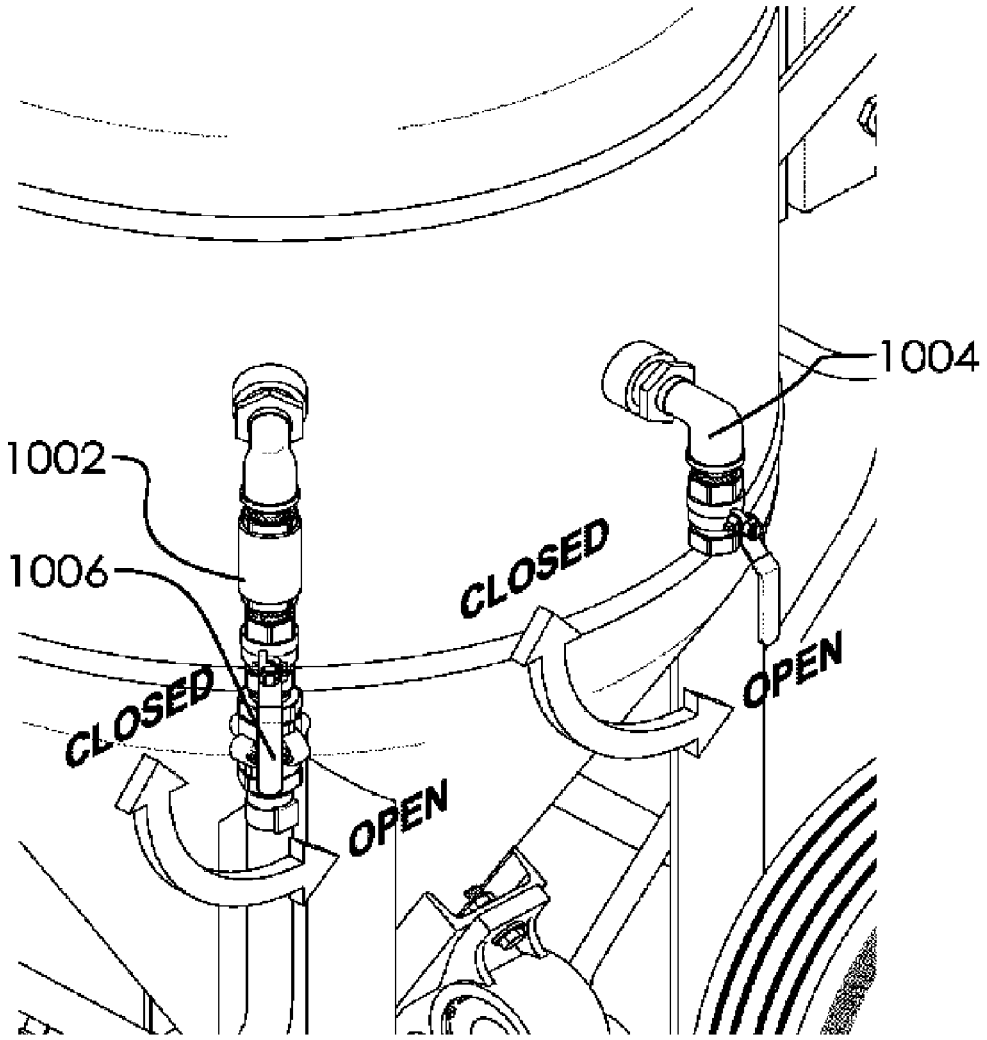
FIGS. 10A and 10B illustrate a perspective overview and a schematic of a fill valve and a relief valve on said blasting system.
Figure 10B:
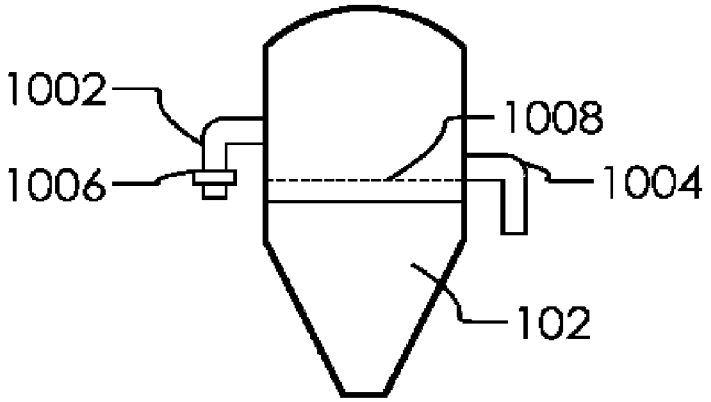

FIGS. 10A and 10B illustrate a perspective overview and a schematic of a fill valve 1002 and a relief valve 1004 on said blasting system 100. In one embodiment, filling said blasting system 100 can comprise adding a fluid into said fill valve 1002. In one embodiment, said fill valve 1002 can comprise a check valve 1006. In one embodiment, said relief valve 1004 can regulate a volume of fluid contained in said tank 102 by forcing fluids to escape once they reach a relief valve level 1008. In one embodiment, said check valve 1006 can keep fluid out of a pump.

Various changes in the details of the illustrated operational methods are possible without departing from the scope of the following claims. Some embodiments may combine the activities described herein as being separate steps. Similarly, one or more of the described steps may be omitted, depending upon the specific operational environment the method is being implemented in. It is to be understood that the above description is intended to be illustrative, and not restrictive. For example, the above-described embodiments may be used in combination with each other. Many other embodiments will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein."

The invention claimed is:

1. A blasting system, comprising:

a tank comprising a center tube, an inlet, a fill valve, an outlet, and a relief valve;

said tank comprises a top end and a bottom end, said outlet located at said top end, said inlet located at said bottom end, said fill valve and said relief valve are positioned in a side portion of said tank;

said relief valve closer to said bottom end of said tank than said fill valve;

wherein said tank receives a fluid through said fill valve;

wherein said tank receives a pressurized air through said inlet;

wherein said bottom end of said tank holds said fluid;

wherein said center tube receives a portion of said pressurized air and selectively receives a portion of said fluid to exit through said outlet for a blasting application;

said relief valve regulates fluid capacity in said tank and relieves pressure from said tank;

said blasting system further comprises a coupling nipple at said bottom end and inside of said tank;

said coupling nipple is in fluid connection with said inlet of said tank and receives said pressurized air;

said coupling nipple selectively couples with a lower portion of said center tube and thereby creates a closed configuration and an open configuration with said center tube; and with said coupling nipple in said closed configuration with said center tube, said center tube only receives said pressurized air and substantially none of said fluid.

2. The blasting system of claim 1 wherein:

said tank comprises a cap, a shell, a cone, a neck, and a refilling aperture;

said cap at said top end;

said cone at said bottom end;

said shell located between said cap and said cone;

said refilling aperture at said top end;

said neck at said bottom end; and a venting cap selectively seals said refilling aperture.

3. The blasting system of claim 1 wherein:

said relief valve comprises an open relief valve configuration and a closed relief valve configuration; and said open relief valve configuration enables said relief valve to release excess fluid from said tank as fluid approaches an overflow level within said tank.

4. The blasting system of claim 1 wherein:

said relief valve comprises an open relief valve configuration and a closed relief valve configuration; and said closed relief valve configuration disables said relief valve from releasing excess fluid from said tank.

5. The blasting system of claim 1 wherein:

said relief valve is positioned in said tank to ensure a correct mixture of fluid and said fluid in said tank.

6. A blasting system, comprising:

a tank comprising a center tube, an inlet, a fill valve, an outlet, and a relief valve;

said tank comprises a top end and a bottom end, said outlet located at said top end, said inlet located at said bottom end, said fill valve and said relief valve are positioned in a side portion of said tank;

said relief valve closer to said bottom end of said tank than said fill valve;

wherein said tank receives a fluid through said fill valve;

wherein said tank receives a pressurized air through said inlet;

wherein said bottom end of said tank holds said fluid;

wherein said center tube receives a portion of said pressurized air and selectively receives a portion of said fluid to exit through said outlet for a blasting application;

said relief valve regulates fluid capacity in said tank and relieves pressure from said tank;

said center tube comprises a one or more hydraulic accumulators above a fluid level inside of said tank; and said one or more hydraulic accumulators comprise apertures in said center tube; and said one or more hydraulic accumulators allow a fluid connection between said tank and said center tube, and thereby equalizes a pressure between one another.

7. The blasting system of claim 6 wherein:

said relief valve comprises an open relief valve configuration and a closed relief valve configuration;

said tank comprises a cap, a shell, a cone, a neck, and a refilling aperture;

said cap at said top end;

said cone at said bottom end;

said shell located between said cap and said cone;

said refilling aperture at said top end;

said neck at said bottom end;

and a venting cap selectively seals said refilling aperture.

8. The blasting system of claim 7 wherein:

said open relief valve configuration enables said relief valve to release excess fluid from said tank as fluid approaches an overflow level within said tank.

9. The blasting system of claim 7 wherein:

said closed relief valve configuration disables said relief valve from releasing excess fluid from said tank.

10. The blasting system of claim 6 wherein:

said relief valve is positioned in said tank to ensure a correct mixture of fluid and said fluid in said tank.

11. The blasting system of claim 6 wherein:

a portion said fluid is ejected from said tank through said center tube at said outlet;

said center tube is attached to a blasting hose;

said blasting hose is attached to a blast nozzle; and said blast nozzle creates a blast stream and directs a portion of said fluid to a target object.

12. The blasting system of claim 11 wherein:

said blasting system further comprises a valve;

a portion of said blasting hose is run through said valve between said tank and said blast nozzle; and said valve comprises an open flow configuration allowing said blast stream to flow through said blasting hose and a closed flow configuration cutting off said blast stream.

13. The blasting system of claim 12 wherein:

said valve is a failsafe device designed to switch into said closed flow configuration if said blasting system loses power or air pressure.

14. The blasting system of claim 11 wherein:
said blasting system further comprises an air compressor;
said air compressor provides said pressurized air to said tank and said valve;
said tank receives said pressurized air from a tank air hose; and
said valve receives said pressurized air from a valve air hose.

15. The blasting system of claim 14 wherein:
said blasting system further comprises a valve;
a portion of said blasting hose is run through said valve between said tank and said blast nozzle;
said valve comprises an open flow configuration allowing said blast stream to flow through said blasting hose and a closed flow configuration cutting off said blast stream; and
said valve is a failsafe device designed to switch into said closed flow configuration if said pressurized air is not available.

16. The blasting system of claim 14 wherein:
said blasting system further comprises a vibrator;
said vibrator receives a portion of said pressurized air from said air compressor through a vibrator air hose;
said vibrator converts said pressurized air into vibration;
said vibrator is attached to a side portion of said tank; and
said vibrator assists in keeping said fluid flowing toward said center tube within said blasting system.

17. The blasting system of claim 11 wherein:
said blasting system further comprises a vibrator;
said vibrator selectively generates vibrations;
said vibrator is attached to a side portion of said tank; and
said vibrator assists in keeping said fluid flowing toward said center tube within said blasting system.

18. The blasting system of claim 11 wherein:
a splash guard is installed over a portion of said blasting hose to direct leaks in said blasting hose downward.

19. The blasting system of claim 11 wherein:
said blasting system further comprises a filter mounted within said tank;
said filter comprises a center aperture through which a portion of said center tube is inserted; and
said filter provides stability to said center tube within said tank.

20. The blasting system of claim 19 wherein:
said filter comprises a first portion, a second portion and a third portion, all extending out from said center aperture in a radial pattern toward said tank;
a portion of said fluid can freely pass through said filter; a portion of said first portion, said second portion and said third portion are welded to an inner surface of said tank;
said filter comprises a plurality of apertures arranged around said center aperture.

21. The blasting system of claim 19 wherein:
an inner diameter of said center aperture is larger than an outer diameter of said center tube, allowing said center pipe to move horizontally within said center aperture.

22. The blasting system of claim 11 wherein:
said blasting system further comprises a coupling nipple at said bottom end and inside of said tank;
said coupling nipple is in fluid connection with said inlet of said tank and receives said pressurized air; and
said coupling nipple selectively couples with a lower portion of said center tube and thereby creates a closed configuration and an open configuration with said center tube.

23. The blasting system of claim 22 wherein:
with said coupling nipple in said closed configuration with said center tube, said center tube only receives said pressurized air and substantially none of said fluid.

24. The blasting system of claim 22 wherein:
with said coupling nipple in said open configuration with said center tube, said center tube receives a portion of said pressurized air and a portion of said fluid at said lower portion of said center tube and channels the same out of said blasting system at said blast nozzle.

25. The blasting system of claim 22 wherein:
said lower portion of said center tube comprises a beveled inner diameter; said coupling nipple comprises a shoulder; and
selectively sealing said center tube on said coupling nipple comprises
inserting a portion of said coupling nipple within said beveled inner diameter of said lower portion.

26. The blasting system of claim 22 wherein:
said blasting system further comprises a position locking assembly comprising a lever, a fulcrum, and a clamp;
said clamp is attached to a portion of said center tube;
said lever comprises a first position and a second position;
placing said lever in said first position rocks said clamp down on said fulcrum and thereby presses said center tube down against said coupling nipple creating a closed configuration; and
placing said lever in said second position rocks said clamp up on said fulcrum and thereby lifts said center tube off of said coupling nipple creating an open configuration.

27. The blasting system of claim 26 wherein:
said position locking assembly further comprises a lock pin for selectively fixing said position locking assembly in said first position or said second position.

28. The blasting system of claim 22 wherein:
said center tube can freely rotate on said coupling nipple; and
said blasting hose can rotate freely relative to said tank.

29. The blasting system of claim 6 wherein:
said tank further comprises a refilling aperture surrounded by a plurality of lug nuts, and a venting cap;
said venting cap selectively seals said refilling aperture;
said venting cap comprises a one or more notches; and
sealing said refilling aperture with said venting cap comprises aligning said venting cap with said refilling aperture, sliding said one or more notches past said plurality of lug nuts, and rotating said venting cap under said plurality of lug nuts.

30. The blasting system of claim 29 wherein:
said venting cap comprises a bleed valve, a lever and a valve release arm; lifting said lever causes said valve release arm to press into said bleed valve;
said venting cap is configured to prevent said venting cap from being removed without pressing said bleed valve.

31. A blasting system, comprising:
a tank comprising, a center tube, an inlet, a fill valve, an outlet, a filter, and a relief valve;
said tank comprises a top end and a bottom end, said outlet located at said top end, said inlet located at said bottom end, said fill valve and said relief valve are positioned in a side portion of said tank;
said relief valve closer to said bottom end of said tank than said fill valve;
wherein said tank receives a fluid through said fill valve;
wherein said tank receives a pressurized air through said inlet;
wherein said bottom end of said tank holds said fluid;

wherein said center tube receives a portion of said pressurized air and selectively receives a portion of said fluid to exit through said outlet for a blasting application;

said relief valve regulates fluid capacity in said tank and relieves pressure from said tank;

said filter comprising a center aperture, and a plurality of side portions;

said plurality of side portions of said filter extend out from said center aperture and selectively press against an inner wall of said tank;

said filter comprises a plurality of apertures between said side portions configured to allow said fluid to pass through said filter;

a portion of said center tube passes through said center aperture of said filter; and said center aperture of said filter comprises a supporting surface configured to allow said center tube to selectively rotate within said filter.

* * * * *